US005349716A

United States Patent [19]

Millar

[11] Patent Number: 5,349,716

[45] Date of Patent: Sep. 27, 1994

[54] SQUEEGEE DEVICE INCLUDING A RESILIENTLY FLEXIBLE BLADE ARRANGEMENT

[75] Inventor: Robert W. Millar, Prospect, Australia

[73] Assignee: Robert Hicks Pty Ltd., Preston, Australia

[21] Appl. No.: 120,634

[22] Filed: Sep. 13, 1993

Related U.S. Application Data

[63] Continuation of Ser. No. 995,348, Dec. 22, 1992, abandoned, which is a continuation of Ser. No. 767,067, Sep. 27, 1991, abandoned, which is a continuation-in-part of Ser. No. 501,654, Mar. 29, 1990, Pat. No. D. 328,807.

[30] Foreign Application Priority Data

Oct. 3, 1989 [AU] Australia ..... 3241/89

[51] Int. Cl.[5] ..... A47L 1/06; A47L 13/11

[52] U.S. Cl. ..... 15/245; 15/236.06

[58] Field of Search ..... 15/105, 111, 117, 121, 15/144.1, 172, 220.1, 236.01, 236.02, 236.05–236.07, 236.09, 245, 245.1; 30/169, 172, 329, 334, 335; 29/81.11; D32/35, 40–43, 46–49

[56] References Cited

U.S. PATENT DOCUMENTS

| | | | |
|---|---|---|---|
| D. 28,990 | 7/1898 | Cumming | D32/41 |
| D. 152,375 | 1/1949 | Seley | D32/41 |
| D. 232,151 | 7/1974 | Spydevold | D32/41 |
| D. 232,344 | 8/1974 | Momcilorich | D32/48 |
| D. 244,345 | 5/1977 | Poveromo | D32/49 |
| D. 253,789 | 12/1979 | Gupta | D32/49 X |
| D. 265,269 | 7/1982 | Frantz | D32/49 X |
| D. 305,818 | 1/1990 | Chen | D32/48 |
| 187,811 | 2/1877 | Carter | 15/245 |
| 2,682,071 | 6/1954 | Linderoth | 15/245 X |
| 3,649,987 | 3/1972 | Tomingas et al. | 15/245 |
| 3,955,234 | 5/1976 | Roefaro | 30/172 X |
| 4,075,730 | 2/1978 | Siemund | 15/245 |
| 4,305,175 | 12/1981 | Burgess, Jr. | 15/236.02 |
| 4,380,840 | 4/1983 | Rieckenberg | 15/245 X |
| 4,495,668 | 1/1985 | Adams | 30/169 X |
| 4,712,269 | 12/1987 | Worthen | 15/236.02 |
| 4,716,616 | 1/1988 | Poon | 15/245 |
| 4,984,324 | 1/1991 | Farris | 15/236.06 X |
| 5,074,027 | 12/1991 | Alviar et al. | 15/245 X |
| 5,101,530 | 4/1992 | Hansen et al. | 15/245 |

FOREIGN PATENT DOCUMENTS

| | | | |
|---|---|---|---|
| 2911422 | 9/1980 | Fed. Rep. of Germany | 15/236.02 |
| 756243 | 9/1933 | France | 15/245 |

*Primary Examiner*—Timothy F. Simone
*Assistant Examiner*—Charles Cooley
*Attorney, Agent, or Firm*—Reed Smith Shaw & McClay

[57] ABSTRACT

A squeegee for the wiping down of curved or flat surfaces, the squeegee including a handle and a blade arrangement mounted substantially transversely to the handle. The blade arrangement preferably comprises a blade body including a pair of spaced apart blade members. The blade body is mounted to a resilient blade back which has a concave curvature along the length of the blade arrangement, i.e., substantially transverse to the handle, the blade back having a predetermined radius curvature of from about 200 to about 1000 millimeters. Each of the blade members is preferably comprised of a resilient material and is preferably disposed at an angle of from about 10° to about 90° to the surface to be wiped. The blade back may be flattened out so as to conform to the contour of the surface being wiped by application of relatively modest force to the handle.

18 Claims, 6 Drawing Sheets

SQUEEGEE DEVICE INCLUDING A RESILIENTLY FLEXIBLE BLADE ARRANGEMENT

CROSS REFERENCES TO RELATED APPLICATIONS

This application is a continuation of U.S. patent application Ser. No. 07/995,348, filed Dec. 22, 1992 and now abandoned, which was a continuation of U.S. patent application Ser. No. 07/767,067, filed Sep. 27, 1991 and now abandoned, which was a continuation-in-part of U.S. Design patent application Ser. No. 07/501,654, filed Mar. 29, 1990 and which has issued as U.S. Pat. No. Des. 328,807.

FIELD OF THE INVENTION

The present invention relates generally to wiping apparatus and, more particularly, to an improved type of hand operated squeegee or surface wiping device.

BACKGROUND OF THE INVENTION

Various devices for cleaning windows, mirrors and other generally smooth and shiny surfaces are known in the art. Windshield wipers and various models of squeegees are examples of such devices.

For instance, U.S. Pat. No. 4,716,616 relates to a flexible squeegee device for cleaning both flat and curved surfaces. The device comprises a handle and a squeegee blade assembly mounted together by a rigid coupling bracket. The device of U.S. Pat. No. 4,716,616 is principally directed to an adjustable handle mechanism for enabling the relative positions of the hand and the blade assembly frame to be varied so that the device can be conveniently used in a pull-in action as well as a side-by-side sweeping action.

A further stated object of the invention of U.S. Pat. No. 4,716,616 is to provide a squeegee device having a flexible blade assembly operative for cleaning flat as well as curved surfaces. The "flexibility" of the squeegee device of U.S. Pat. No. 4,716,616 primarily resides in the highly flexible rubber squeegee blade thereof which is stated as being more flexible than the stiff, wide rubber blade used in common non-flexible squeegee devices and which is further identified as being similar to that used in common automobile windshield wiper blades. The rubber blade is attached to a slotted, U-shaped channel frame member which may be made from molded plastic, extruded metal or metal alloy. Although the channel frame member is referred to as being flexible, any flexibility is, in practice, substantially limited by its non-planar U-shaped cross-section. Indeed, its flexibility would be virtually nil were it not for the provision of slots in the upstanding leg portions of the channel member. Such involved design considerations result not only in a product that is difficult to manufacture but also one that is inherently fragile and easily broken. That is to say, fabrication of the U-shaped channel member requires employment of elaborate molds or, alternatively, an extrusion process followed by a cutting of the U-shaped channel to produce the requisite flexure accommodation slots. Moreover, the slots create weakened regions in the channel member that serve as focal points for the development of stress or fatigue fractures which result from the repeated flexing and unflexing of the squeegee device during its service life, which fractures become worsened under extreme climate conditions. Consider, for example, the prospect of using such a squeegee device under icy conditions wherein the material forming the channel member would become somewhat brittle; the likelihood of breakage of the channel member would actually be enhanced because of the presence of the flexure slots.

Furthermore, the U-shaped channel member of the squeegee device of U.S. Pat. No. 4,716,616 also possesses rather involved design features for enabling its attachment to the squeegee device as well as for receiving and retaining the squeegee blade. The squeegee handle is also provided with customized attachment structure and is joined to the U-shaped channel via a complicated coupling bracket. The squeegee blade itself further comprises an elaborate cross-sectional configuration in order to enable its slidable engagement with the U-shaped channel member. The device also includes additional parts. Thus, the handle, coupling bracket, channel member and wiper blade all possess rather complex, intricate shapes which are neither simple nor inexpensive to manufacture, and are potentially susceptible to premature failure.

SUMMARY OF THE INVENTION

The present invention provides a squeegee device adapted to wipe an assortment of surfaces having wide ranges of curvature, whether they be painted, formed of glass, metal, plastic or other suitable material, and whether they be flat or curved, concave or convex.

The squeegee of the present invention is particularly adapted for wiping fluids from surfaces and profiles, including, but not limited to, surfaces of motor vehicles, pleasure boats, light aircraft and gliders.

According to the invention, there is provided a squeegee of uncomplicated design for wiping a surface, the squeegee comprising a handle and a resiliently flexible elongate blade arrangement mounted substantially transverse to the handle. The blade arrangement has a concave curvature in a longitudinal direction thereof and desirably comprises a resiliently flexible and substantially planar blade back means having secured thereto a flexible blade body, wherein the blade body preferably comprises a substantially planar portion which is secured to the blade back means with a blade means depending from the blade body. The blade arrangement has a concave curvature along its longitudinal direction, i.e., in a direction substantially transverse to the handle, and is sufficiently flexible to allow the blade arrangement to deform in use so as to allow the blade means to maintain substantial contact with a flat surface or a surface having a radius of curvature substantially the same as or different from that of the blade arrangement.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 1:
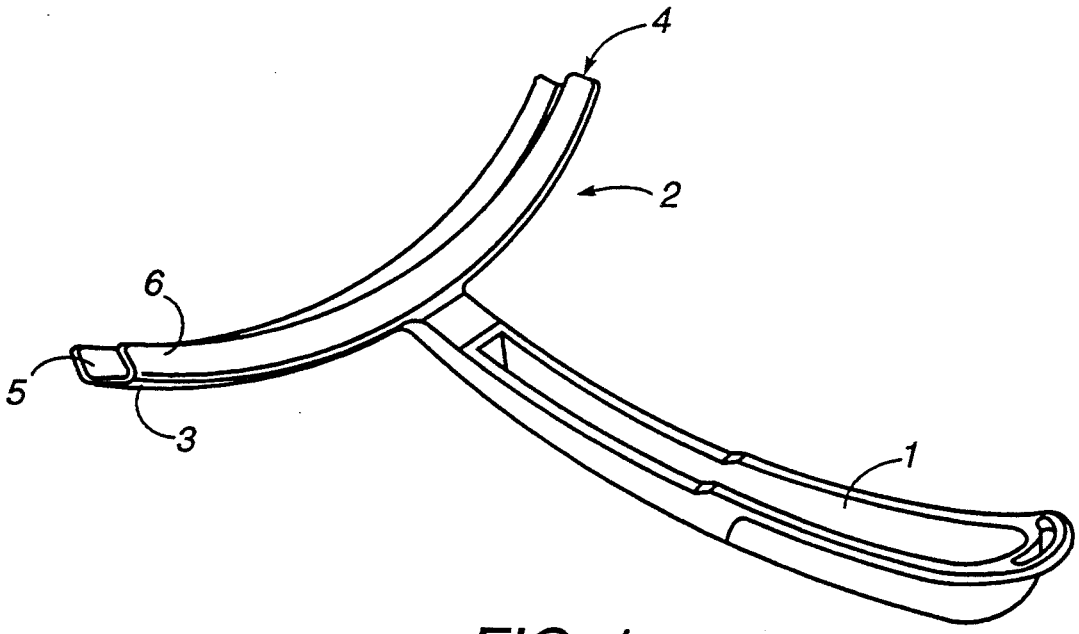
FIG. 1 is a perspective view of the underside of a preferred embodiment of a squeegee device constructed in accordance with the present invention.
Figure 2:
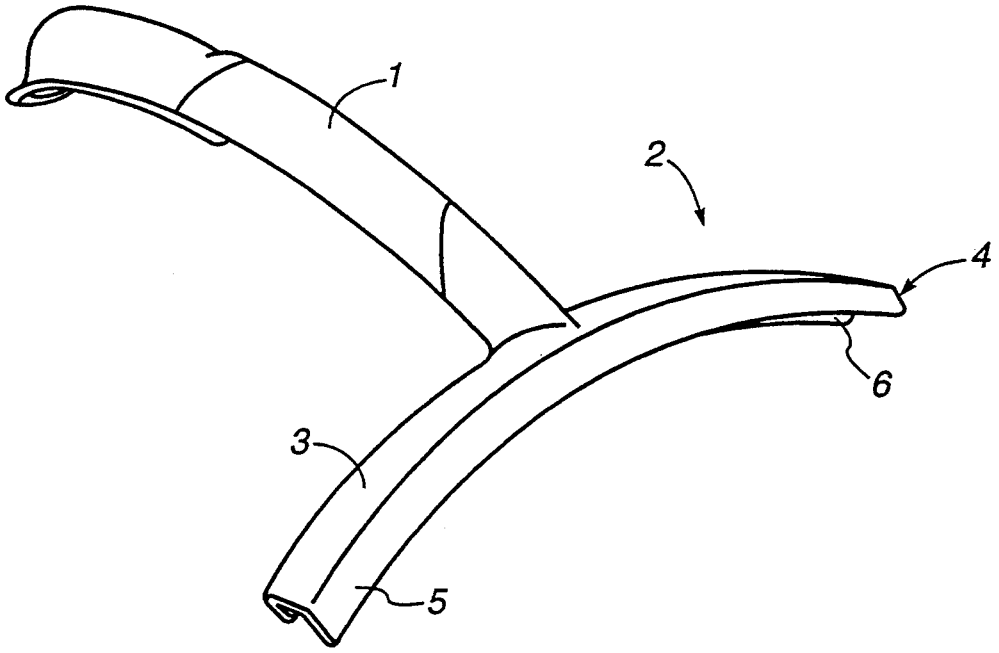
FIG. 2 is a perspective view of the upper side of the squeegee device shown in FIG. 1.
Figure 5:
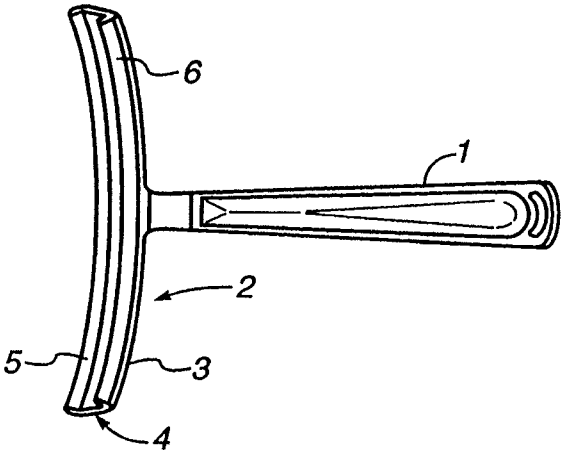
FIG. 5 is a bottom view of the squeegee device of FIG. 1.
Figure 4:
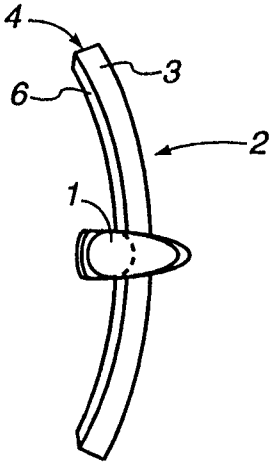
FIG. 4 is a rear-end view of the squeegee device as seen from line IV—IV of FIG. 3.
Figure 3:
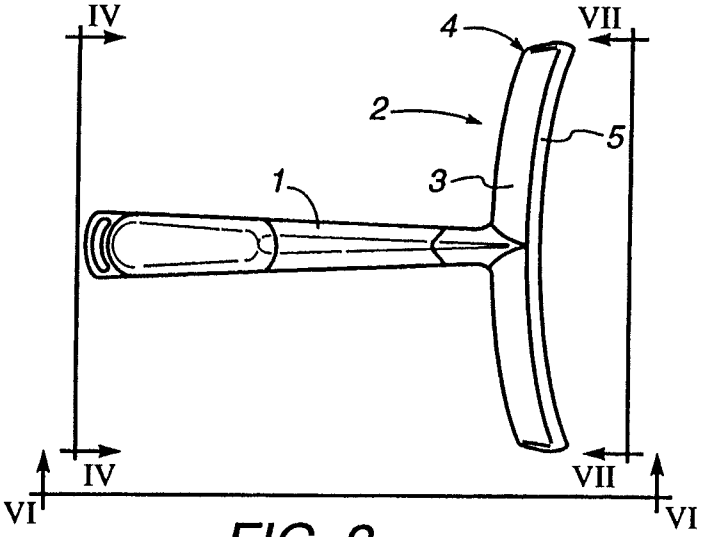
FIG. 3 is a top view of the squeegee device shown in FIG. 1.
Figure 7:
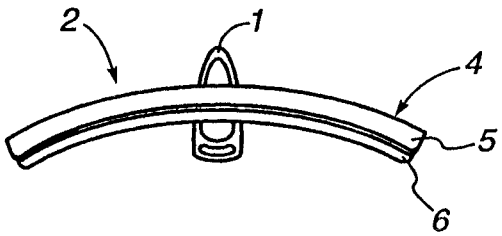
FIG. 7 is a front-end view, opposite to the rear-end view shown in FIG. 4, of the squeegee device as seen from line VII—VII of FIG. 3.
Figure 6:
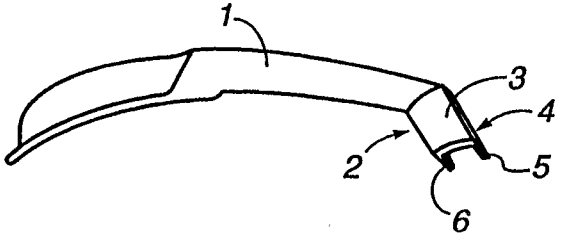
FIG. 6 is a side view of the squeegee device as seen from line VI—VI of FIG. 3.

Turning to the drawing figures, in particular FIGS. 1–7 and 10, it is revealed that the squeegee device of the present invention generally comprises a handle 1 and a blade arrangement, the blade arrangement being generally designated by reference numeral 2 and extending substantially transverse to the handle. According to this particular embodiment, the handle 1 is preferably integrally molded with a blade back means 3 and affixed to the blade back means 3 is a blade body 4 upon which is desirably mounted a blade means in the form of two blade members 5 and 6. It will be noted that the blade members 5 and 6 are angled away from the handle 1 so that when the squeegee device is drawn towards a user, the blade members 5 and 6 are in a trailing position.

It will be noted that the blade back 3 preferably has a concave curvature in its longitudinal direction, i.e., in a direction substantially transverse to the handle 1, similar to the manner shown in the figures.

Figure 8:
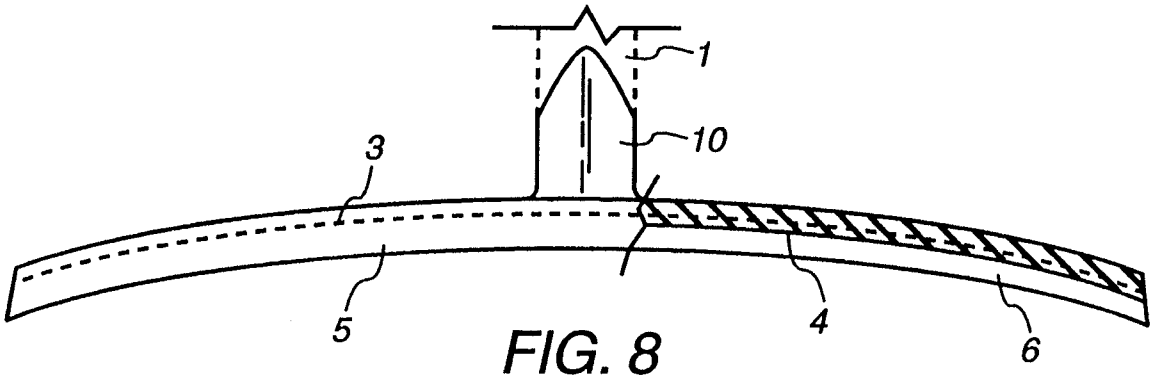
FIG. 8 is a front view, in partial section, of a further preferred embodiment of the squeegee device of the present invention.

As can be seen in FIG. 8, which shows a further embodiment of the instant invention, a handle socket 10 is provided into which a handle is removably insertable. The socket 10 is preferably molded integrally with the blade back means 3, although it may be suitably attached by mechanical means such as adhesives or fasteners, if desired. This figure illustrates a partial sectional view revealing a preferable arrangement wherein the blade back means 3 (shown in dashed line) has mounted thereto the blade body 4. The blade body is secure to the blade back means preferably by an adhesive or some other suitable arrangement and preferably extends beyond the ends of the blade back means. Blade members 5 and 6 depend from the blade body 4. The blade body desirably extends beyond the blade back means such that the longitudinal ends of the squeegee device are formed of soft yieldable material, i.e., the material of the blade body and the blade members, whereby damage will not occur to the surface being wiped if the squeegee ends are scraped against the surface.

Figure 9:
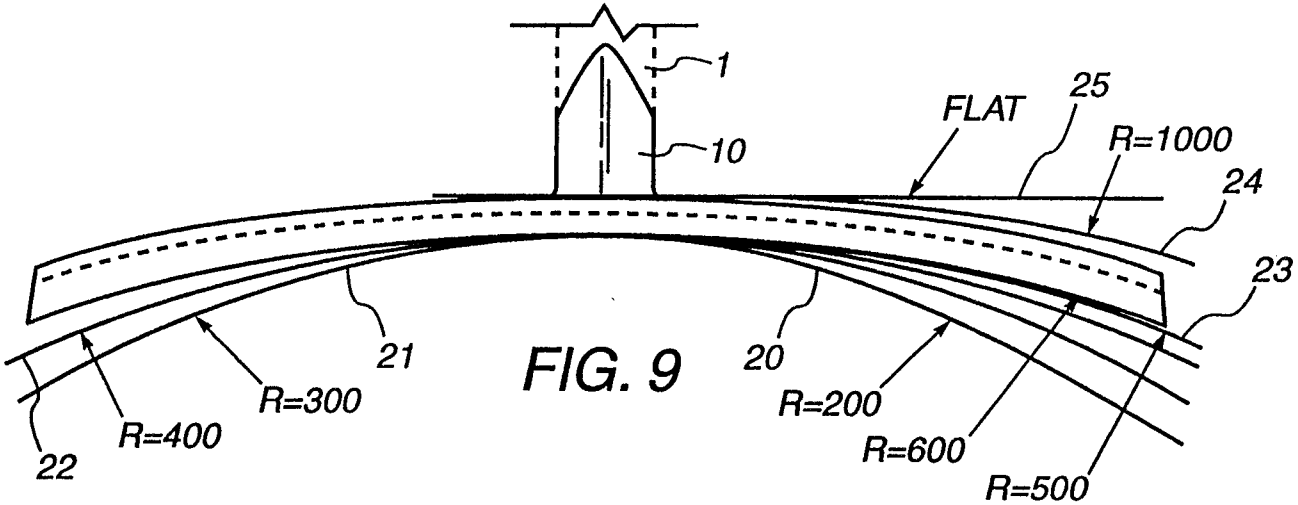
FIG. 9 is a view similar to FIG. 8 illustrating some of the various predetermined curvatures the squeegee device may assume.

FIG. 9 shows a typical range of curvatures to which the blade back means 3 may be molded out of resilient material in order to achieve the objects and advantages of the present invention. Although provided for purposes of illustration, but not to be construed as limitation thereof, suitable curvatures may range from about 200 millimeters as shown by line 20, to about 300 millimeters as shown by line 21, 400 millimeters as shown by line 22, 500 millimeters as shown by line 23 (with the actual blade arrangement shown at a curvature of about 600 millimeters) to a radius of curvature of about 1000 millimeters as represented by line 24. Line 25 demonstrates the blade in the flat position when it has a force applied on the handle of from about 200 to 700 grams, depending upon the as-molded radius of curvature of the blade back means 3, when the ends of the blade members are on a flat surface. In this connection, it is most desirable that the blade back means be of such a construction that a force of about 400 grams will sufficiently flatten the blade arrangement to conform to the contour of the surface to be wiped. And, while the concave curvature of the squeegee blade arrangement 2 may have a radius of curvature of from about 200 millimeters to about 1000 millimeters, it is preferred that the concave curvature have a radius of curvature of about 500 millimeters.

Further, even though the minimum preferred radius of curvature generally imparted to the blade body 4 and thus the blade members 5 and 6 is about 200 millimeters, it will be appreciated that surfaces of a lesser radius of curvature than this can also be wiped by angling the squeegee blade to the direction of travel. This advantage of being able to wipe surfaces of relatively pronounced curvature, of course, cannot be done with existing squeegees having generally straight blades and inflexible blade backs.

Figure 10:
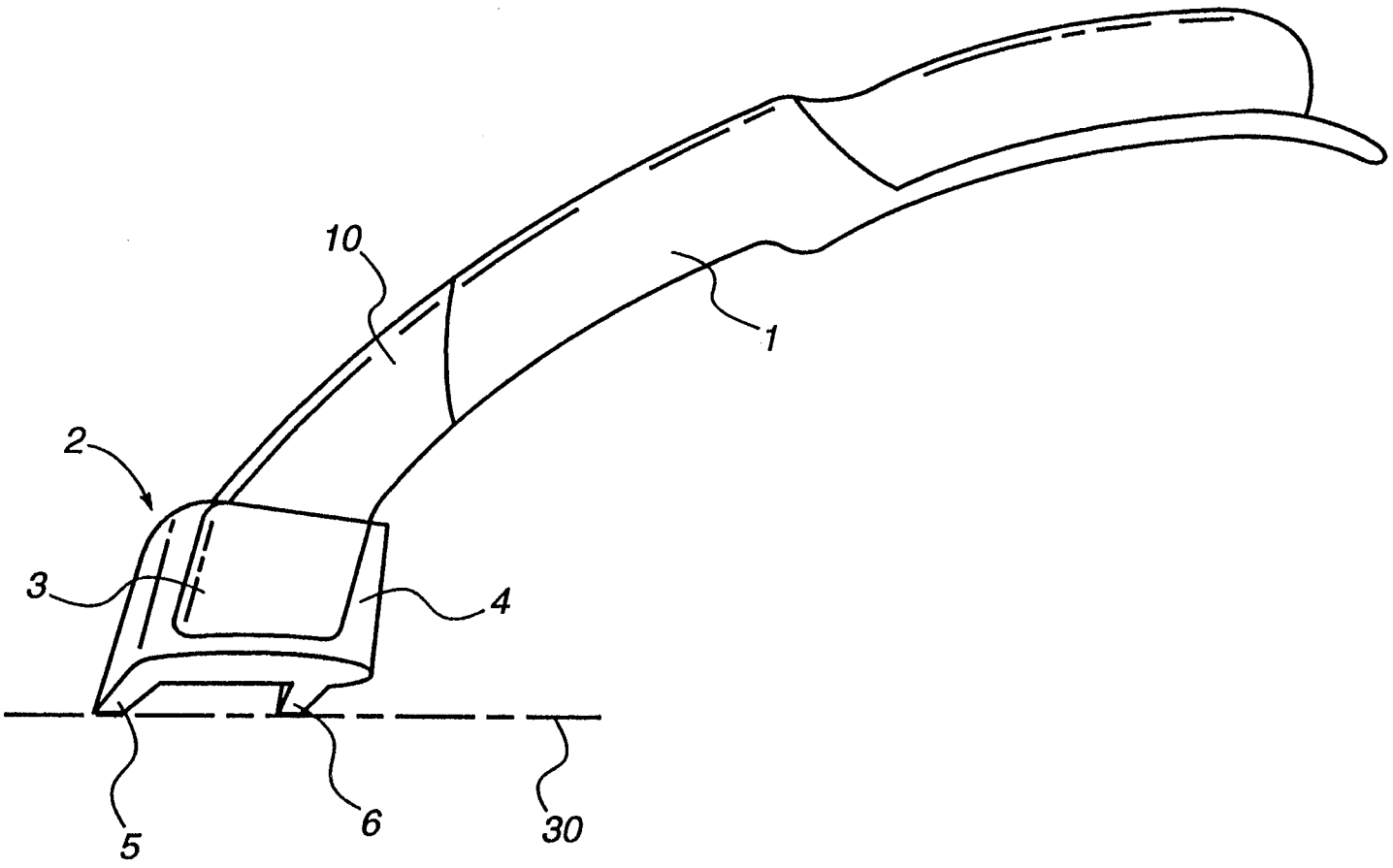
FIG. 10 is an enlarged side view of the further preferred embodiment of the squeegee device of the present invention.

FIG. 10 shows essentially the embodiment of squeegee shown in FIG. 8 with the handle 1 plugged into the handle socket 10. It can be particularly seen in this embodiment that the blade members 5 and 6 are angled away from the handle 1 so that they are trailing when the squeegee is held in the hand and drawn towards the user.

Figure 11:
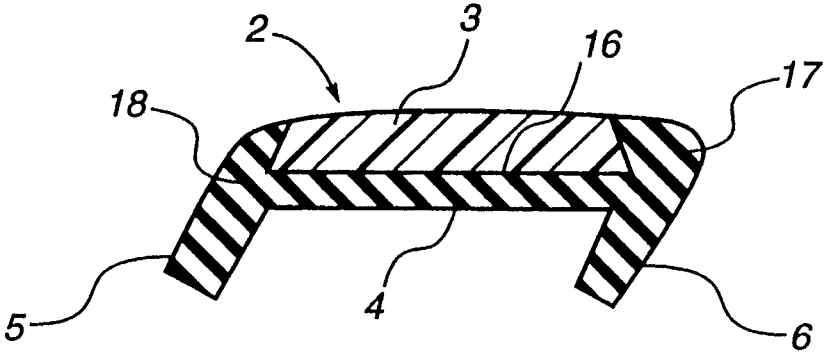
FIG. 11 is a cross-sectional view of a preferred squeegee blade arrangement of the squeegee device of the present invention.

FIG. 11 shows the cross section of a preferred blade arrangement 2 according to the present invention. In this figure it can be seen that the blade back means 3 is substantially flat in lateral cross section and desirably has a substantially flat lower surface 16 which is preferably adhered to the blade body 4. The blade body 4 also preferably has bumper ends 17 and 18 fitting over each end of the blade back means 3 to further serve to prevent impact damage to paintwork or any other surface that is being wiped. Additionally, it is preferred that the longitudinal edges of the blade back means 3 be bevelled and the associated edges of the blade body 4 be substantially matingly undercut in order to enhance resistance to detachment of the blade body 4 from the blade back means. Hence, the blade back means 3 assumes the uncomplicated shape of a substantially planar member having a predetermined concave curvature along its length which is preferably unencumbered by additional elaborate and inherently fragile reinforcement structure such as, for example, the upstanding slotted channel of the flexible frame of the squeegee device described in U.S. Pat. No. 4,716,616. As a result of the instant design, a squeegee device is provided that is rugged, long-lasting, less costly to manufacture and useful on surfaces of a wider range of curvatures than presently available flexible squeegee devices.

Figure 12:
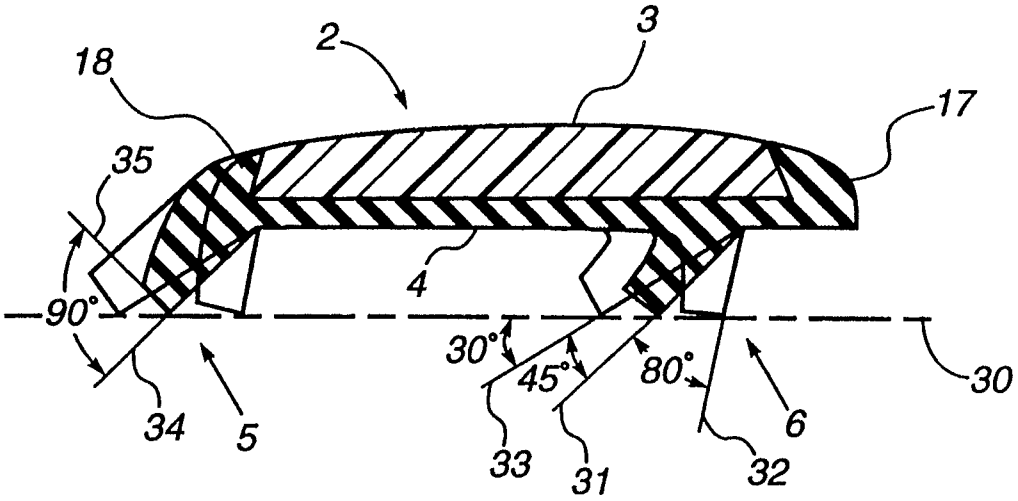
FIG. 12 is a cross-sectional view similar to FIG. 11 depicting a range of strike angles which may be used in construction of squeegee blade members adapted for use in the squeegee device of the present invention.

FIG. 12 shows a further cross sectional view of the blade arrangement 2 of the present invention with a range of suitable blade angles depicted. In particular, it is preferred that the blade members 5 and 6 be disposed in use at an angle of about 45° to about 50° relative to a surface 30 upon which the squeegee is drawn, as is represented by the line 31. However, the blade members may suitably be angled from about 80° as shown by line 32 to about 30° as shown by line 33, although a range of from about 10° to about 90° would be acceptable. Preferably each of the blade members is disposed at the same angle. The blade members 5 and 6 depicted in FIG. 12 are squared tip blades, wherein the rearward edges of the blade act as the contact surfaces and the lines 34 and 35 illustrate the square tip angle of the blades.

Figure 13C:
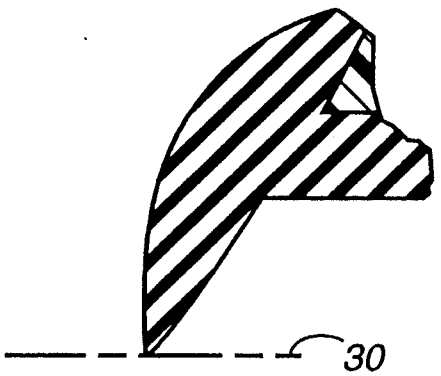
FIGS. 13A, 13B and 13C illustrate enlarged views of several embodiments of squeegee blade configurations which may be used in the squeegee device of the present invention.
Figure 13B:
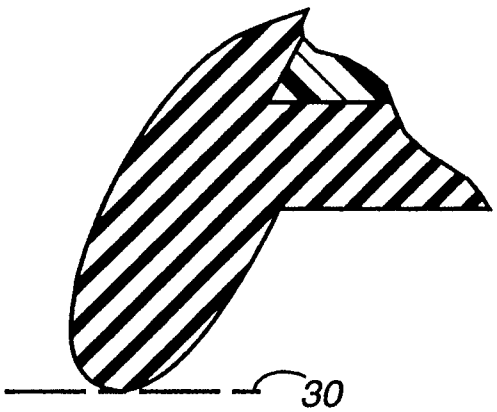
Figure 13A:
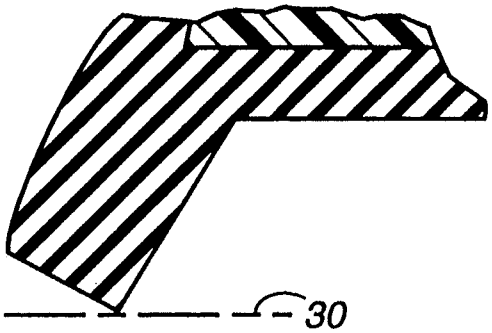

FIGS. 13A, 13B and 13C reveal on an enlarged scale a number of contemplated blade shapes suitable for use in the squeegee device of the present invention.

In particular, FIG. 13A shows a substantially square blade shape similar to that shown in FIGS. 11 and 12 with the contact edge being a substantially square angle impinging upon a hypothetical surface 30. This construction provides ample support for the blade edge and gives maximum prevention for buckling of the contact point of the blade.

FIG. 13B shows an alternative embodiment of blade shape comprising essentially a curved or rounded tip blade which again provides very good support for the blade edge surface.

FIG. 13C shows a generally pointed blade edge which is particularly applicable for drying fine surfaces; however, owing to its fine pointed nature, may be required to be made from a harder material than say, for example, the blade configuration shown in FIGS. 13A and 13B.

The actual shape of the blade members 5 and 6 is of importance to ensure good wiping characteristics; and the contact surface of the blade members 5 and 6 may have, as noted above, a shape selected from square, rounded, or pointed, or perhaps some other suitable shape, depending upon the intended use of the squeegee device. For the greatest range of applications, however, the square shape shown in FIGS. 11, 12 and 13A is preferred because as the blade member 5 or 6 is dragged across the surface to be wiped, one edge of the squared blade provides the wiping surface and is reinforced by the significant thickness of the blade such that a substantially hard and well supported point is provided.

In the generally preferred embodiments of the invention herein shown and described, the blade arrangement 2 may comprise two blade members 5 and 6 spaced apart in the direction of travel of the squeegee in use. The blade members 5 and 6 may be mounted to a blade back 3 and are preferably parallel to each other and preferably angled to the blade back 3 at an angle of from about 10° to 90° away from normal direction of travel of the squeegee in use.

In addition, the blade members 5 and 6 may be spaced apart from about 10 millimeters to about 40 millimeters with a preferred spacing being about 20 to 25 millimeters.

Moreover, although specifically illustrated herein and described by way of example as having two blade members, the blade body 4 may also conceivably be provided with one or greater than two blades. And, if a plurality of blade members are provided, their spacing, disposition angles and/or profile configurations may vary relative to one another, as may be desired or necessary.

The material for forming at least the blade members, or, if manufactured in a single molding, the blade body and the blade members, may be selected from resilient materials, including, but not limited to, thermoplastic rubbers, urethane, silicon rubbers, natural rubbers, and ethylene vinyl acetate, with thermoplastic rubbers being preferred. To ensure that the blade members 5 and 6 maintain good contact with the surface to be wiped, it is preferable that they be hard enough to perform thorough wiping but not so hard that they will bounce when striking a surface irregularity. Preferably, a material having a range of Durometer A hardness from about 40 to 70 is acceptable with a more desired value being about 50 Durometer A.

The blade back means 3 is preferably made from a material sufficiently resiliently flexible such that by applying pressure on the handle 1 of the squeegee, the concave curvature of the blade arrangement 2 may be flattened out. Preferably, the force necessary to provide the flattening out may range from about 200 to about 700 grams. Most desirably, the blade back 3 may be designed so that the force necessary to flatten the blade is about 400 grams. Accordingly, it is presently contemplated that the blade back means 3 may be suitably comprised of a resilient material selected from the group comprising polypropylene, polyvinyl chloride, nylon, acetal, styrene or ABS, with polypropylene being preferred.

Further, as previously stated, the handle 1 of the squeegee may be molded as a single molding with the blade backing or may be made removable therefrom with a socket arrangement. Additionally, as is perhaps best appreciated from looking again at FIG. 10, the angle that the handle makes to the hypothetical surface 30 may be varied to suit conditions and may range anywhere from about 10° to 90°, with a preferred angle of the handle to the surface being wiped being about 50°.

As the reader will appreciate, by virtue of the uncomplicated nature of the design, manufacture and assembly of the handle 1, the substantially planar back means 3 and the blade body 4 (including any blade means depending therefrom), an improved squeegee device is provided which is suitable for wiping surfaces having a wide range of curvature radii, yet is also highly durable and simpler and less costly to manufacture than presently available squeegee devices.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A squeegee comprising: a handle and a resiliently flexible elongated blade arrangement extending substantially transverse to the handle, said blade arrangement having a concave curvature in a longitudinal direction transverse to the handle and including a resiliently flexible blade back, said blade back being substantially flat in lateral cross section without slots to substantially enhance flexure of the blade back and having secured thereto a flexible blade body, said blade body including at least one substantially planar blade member depending therefrom at an acute angle relative to the blade back, said blade back being sufficiently flexible to allow said blade arrangement to deform under application of force so as to enable said blade member to maintain substantial contact with a surface to be wiped.

2. A squeegee as in claim 1 wherein said acute angle is an angle of from about 30° to about 80°.

3. A squeegee as in claim 2 wherein said acute angle is an angle of from about 45° to about 50°.

4. A squeegee as in claim 1 wherein the concave curvature has a radius of curvature of from about 200 millimeters to about 1000 millimeters.

5. A squeegee as in claim 4 wherein the concave curvature has a radius of curvature of about 500 millimeters.

6. A squeegee as in claim 1 wherein said at least one blade member comprises two blade members extending longitudinally along the blade body and spaced apart in a direction of travel of the squeegee in use.

7. A squeegee as in claim 6 wherein said blade members are spaced apart from about 10 millimeters to about 40 millimeters.

8. A squeegee as in claim 7 wherein said blade members are spaced apart by about 20 to 25 millimeters.

9. A squeegee as claim 6 wherein each of said blade members include a contact surface having a shape selected from the group comprising squared, rounded and pointed.

10. A squeegee as in claim 1 wherein said at least one blade member is formed from a material selected from the group comprising thermoplastic rubbers, urethanes, silicon rubber, natural rubbers, and ethylene vinyl acetates.

11. A squeegee as in claim 1 wherein said blade back is formed from a flexible material such that the concave curvature of said blade arrangement may be deformed by application of a force of from about 200 to 700 grams.

12. A squeegee as in claim 11 wherein the force is about 400 grams.

13. A squeegee as in claim 1 wherein said blade back is formed from a material selected from the group comprising polypropylene, polyvinyl chloride, nylon, acetal, styrene and ABS.

14. A squeegee as in claim 1 wherein said at least one blade member is formed from a material having a Durometer A hardness ranging from about 40 to 70 Durometer A.

15. A squeegee as in claim 14 wherein said at least one blade member material has a hardness of about 50 Durometer A.

16. A squeegee as in claim 1 wherein said blade back is free of flexure accommodation joints extending substantially transverse to said longitudinal direction of said blade arrangement.

17. A squeegee comprising: a handle and a blade arrangement mounted substantially transversely to said handle, said blade arrangement including a resilient blade back substantially flat in lateral cross section without slots to substantially enhance flexure of the blade back, said resilient blade back being concave in a longitudinal direction transverse to the handle and having a radius of curvature from about 200 to about 1000 millimeters, a blade body mounted to the resilient blade back, and at least one blade member depending from the blade body and extending longitudinally thereof, said at least one blade member being comprised of a resilient material and disposed at an angle from about 30° to about 80° relative to said blade back, wherein said blade back may be deformed by application of a force on the handle from about 200 to about 700 grams.

18. A squeegee as in claim 17 wherein said at least one blade member comprises a plurality of blade members, said blade members being spaced apart from about 10 to about 40 millimeters in a direction of travel of the squeegee in use.

* * * * *